US007089859B2

(12) United States Patent
Caban et al.

(10) Patent No.: US 7,089,859 B2
(45) Date of Patent: Aug. 15, 2006

(54) DOCUMENT WITH INTEGRATED COATING

(75) Inventors: Michael E. Caban, Riverview, FL (US); Doug Richards, Riverview, FL (US); James J. Carides, Tampa, FL (US); Marianne Cavanaugh, Tampa, FL (US); Joe Mosby, Brandon, FL (US)

(73) Assignee: Rx Label Corp., Joplin, MO (US)

( * ) Notice: Subject to any disclaimer, the term of this patent is extended or adjusted under 35 U.S.C. 154(b) by 0 days.

(21) Appl. No.: 10/663,814

(22) Filed: Sep. 17, 2003

(65) Prior Publication Data

US 2005/0056176 A1 Mar. 17, 2005

(51) Int. Cl.
*B41F 33/00* (2006.01)

(52) U.S. Cl. ..... 101/483; 101/424

(58) Field of Classification Search ..... 101/423–425, 101/416.1, 483; 15/104.93, 104.002, 256.51, 15/256.52, 256.53
See application file for complete search history.

(56) References Cited

U.S. PATENT DOCUMENTS 5,223,329 A * 6/1993 Amann ..... 428/198
5,227,844 A * 7/1993 Bhattacharjee et al. ..... 399/99
5,423,411 A * 6/1995 Kennett ..... 198/494
5,457,843 A * 10/1995 Gelardi et al. ..... 15/229.12
5,536,328 A * 7/1996 Morgavi ..... 134/6
5,614,928 A * 3/1997 Matsuda ..... 347/2
5,616,386 A * 4/1997 Okada et al. ..... 428/40.1
5,751,306 A * 5/1998 Sakaki et al. ..... 347/22
5,782,496 A * 7/1998 Casper et al. ..... 283/81
5,875,719 A * 3/1999 Francis ..... 101/424
5,926,197 A * 7/1999 Kessler ..... 347/171
6,001,472 A * 12/1999 Ikeda et al. ..... 428/343
6,129,019 A * 10/2000 Tobol et al. ..... 101/424
6,277,457 B1 * 8/2001 Onishi et al. ..... 428/40.1
2002/0112300 A1 * 8/2002 Muhr-Sweeney ..... 15/104.002

* cited by examiner

*Primary Examiner*—Anthony H. Nguyen
(74) *Attorney, Agent, or Firm*—DLA Piper Rudnick Gray Cary US LLP

(57) ABSTRACT

A coated document with debris-removing characteristics which provides enhanced debris removal when printed using conventional printing devices is provided. The documents described herein may be coated on portions of both faces, and optionally contain self-adhesive labels or coloring agents.

30 Claims, 4 Drawing Sheets

DOCUMENT WITH INTEGRATED COATING

FIELD OF THE INVENTION

The present invention relates generally to documents. More particularly, the present invention relates to documents prepared with a coating to provide debris-removing characteristics.

BACKGROUND OF THE INVENTION

With the availability of high speed printing devices, the capacity to use such printing devices for volume printing of documents has become increasingly desirable. However, the long term use of non-impact printers such as laser, thermal transfer, or ink jet imaging has been less than satisfactory for a number of reasons. In particular, the accumulation of contaminants in the form of unbound ink, adhesives, and paper dust, adhering to the internal machinery of the printing devices, causes premature and often expensive servicing of the automated equipment after limited handling cycles.

Though problems arising from contamination can be evident when passing any paper product though a printer (e.g., paper dust), the problem may be exacerbated when printing adhesive-bearing documents such as labels, stickers, and decals. This class of documents has a variety of uses including imparting information about a product to a user thereof, and in many instances, an adhesive is used to secure labels or decals to an underlying surface. In many applications, information is printed directly onto a label or decal surface prior to use, typically imparted using computer-controlled, non-impact printers. Impact printers such as dot matrix printers are also used.

Current label designs can contaminate a printer with adhesive and prevent proper functioning of the printer over time. For example, a first pass through a laser printer's fuser section can lead to hot-melt and emulsion acrylic adhesives becoming more fluid. This problem is only compounded in duplex printing, where such documents may undergo multiple passes though a printer, leading to greater fluidity of adhesive and likelihood of escape from the context of the document and onto internal printer parts.

Small amounts of adhesive extruded from between the label portions begins to accumulate within the printer over time. A moderately sized pharmacy printer, for example, may print 300 to 500 pharmacy labels and forms per day, resulting in a frequent need to clean, repair, or replace the printer. If the contamination is extensive enough, it can severely damage the printer. Often times, the rollers, fusers, toners, and wipers, for instance, need to be cleaned and/or replaced. The cost of maintenance and repairs and utility lost in repair time contribute significantly to production costs.

Therefore, it is desirable to provide a document with debris-removing characteristics which can minimize the relative level of contamination generated upon each pass through the printer. It is also desirable to provide a document with debris-removing characteristics that can reduce debris that may have already collected within the printer.

SUMMARY OF THE INVENTION

In accordance with one embodiment of the present invention, a document is provided with a debris-removing coating on a portion of the surface of the document. The debris-removing coating is preferably present on at least a portion of a surface opposite to that concurrently printed upon when passing through the printer. However, the coated document may be printed on one or both sides and consequently the coating may be applied to one or both sides. In other embodiments, one or both faces of the coated document may contain self-adhesive labels. In yet other embodiments, the coated document may be colored.

In accordance with another embodiment of the present invention, a method is provided of producing a document with a debris-removing coating. The method includes providing a document, and coating a portion of the document with a debris-removing coating. The document may be printed on one or both sides. In other embodiments, one or both faces of the document may contain self-adhesive labels. In yet other embodiments, the coated document may be colored.

In accordance with another embodiment of the present invention, a method is provided of reducing or removing contamination from within a printer comprising providing a document with a debris-removing coating on some portion of the surface of the document, and running the document though a printer. In some embodiments, the coating is provided on a surface opposite to that concurrently printed upon when passing through the printer. In yet other embodiments, the coated document may be printed on one or both sides and therefore, the document may be coated on one or both sides. In other embodiments, one or both faces of the document may contain self-adhesive labels. In yet other embodiments, the coated document may be colored.

There has thus been outlined, rather broadly, some features of the invention in order that the detailed description thereof that follows may be better understood, and in order that the present contribution to the art may be better appreciated. There are, of course, additional features of the invention that will be described below and which will form the subject matter of the claims appended hereto. Further, since numerous modifications and variations will readily occur to those skilled in the art from the teachings herein, it is not desired to limit the invention to the exact construction and operation illustrated and described, and accordingly, all suitable modifications and equivalents may be resorted to, falling within the scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF EMBODIMENTS OF THE INVENTION

An embodiment of the present invention provides a document with debris-removing coating which, when run through a printer, reduces the accumulation of printing contaminants from within the printer as compared to printing documents without a debris-removing coating. Documents of this invention may be used with any known printer in the art, including, but not limited to, laser printers, thermal printers, ink jet printers, and thermal transfer printers. In some embodiments, the invention provides a document with debris-removing coating which reduces contaminants that may already be present in the printer.

Ultraforce Phase 81 (Product No. WX081B1), commercially available from Arcar, Inc, is a desirable coating in some embodiments, in part, because it keeps the printing unit cleaner, longer. One of ordinary skill in the art will appreciate from the teachings herein, that some or all of the physical values for coatings of the instant invention may differ to some extent from those specified below depending on the specific coating, but that variations are to be expected and are within the scope and spirit of the present invention.

Technical Data for the Arcar, Inc. Ultraforce Phase 81 coating is as follows:

| | |
|---|---|
| Substrates | Paper and a wide variety of films |
| Strength level | 1.0–2.5 BCM |
| pH | 8.5–9.0 |
| Color Reduction | Use extender/transparent white |
| Cleanup wet and dry | Use soap and water |
| Process Printing | Solid screen dots without "donut holes" |
| Heat Resistance | Up to 500° F. without catalyst |
| Laminating Bond Strength | Destructible (testing required) |

Figure 1:
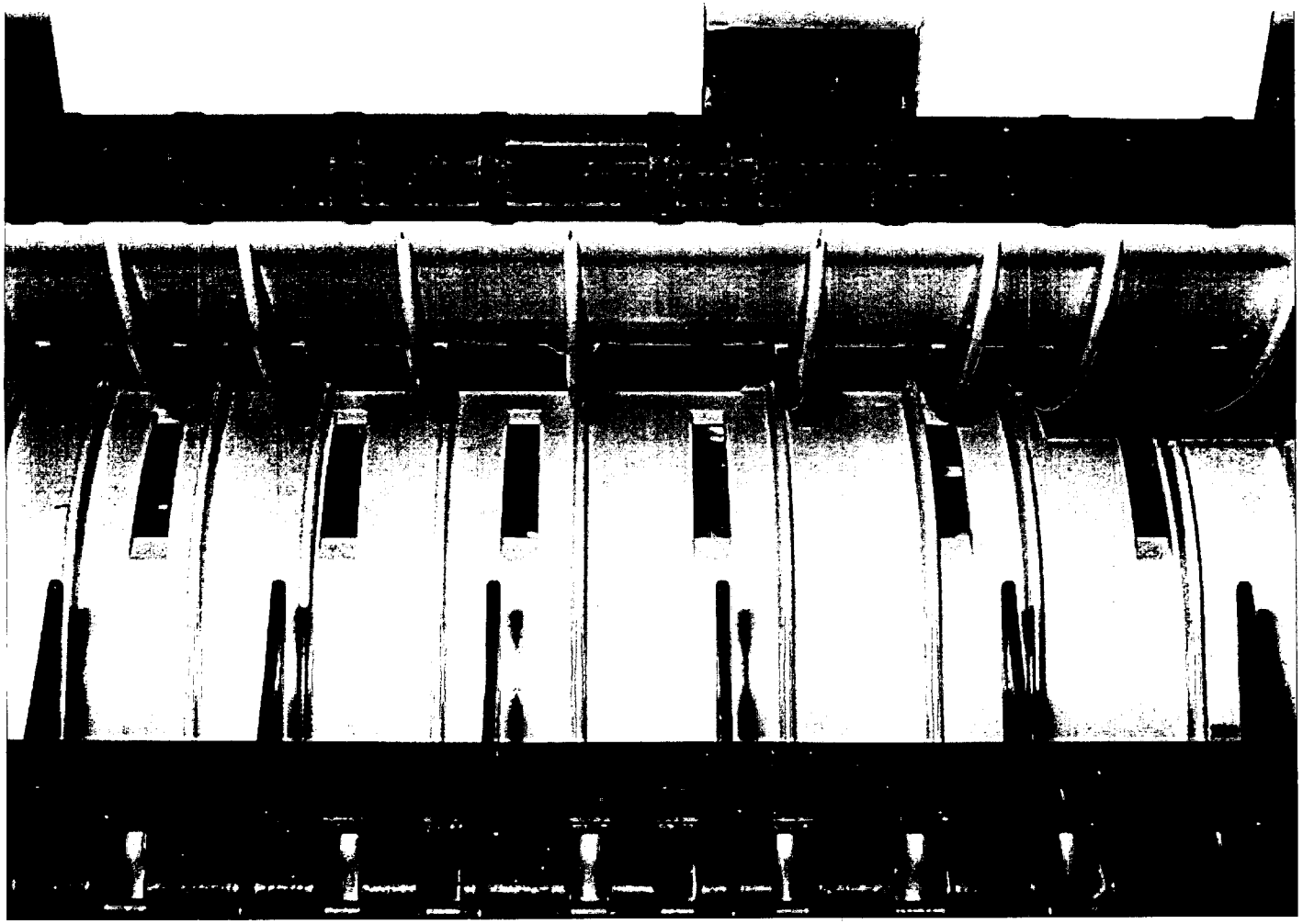
FIG. 1 is a color photograph of the re-drive ribs of a Lexmark T-620 duplex printer after 30,000 sheets of double-sided labels were printed. The labels were coated with Arcar, Inc. Ultraforce Phase 81 as indicated in the text.

Tests were run to determine the efficacy of debris removal using the Arcar coating mentioned above. The coating was applied to both faces of documents containing self-adhesive labels on both sides. Four independent tests were run on four independent printers. Three tests were performed on Lexmark T-620 duplex printers and one test was performed on a Lexmark T-522 duplex printer. Thirty thousand labels were printed on both sides (i.e., duplex printing) through the printers and the internal machinery checked at 10,000-sheet intervals. FIG. 1 shows the re-drive ribs of the printer. Generally, the nine "ribs" shown in the photograph accumulate ink and paper deposits that cover over an inch of each rib surface. However, the ribs shown have minimal, if any, contamination even after 30,000 sheets.

Figure 2:
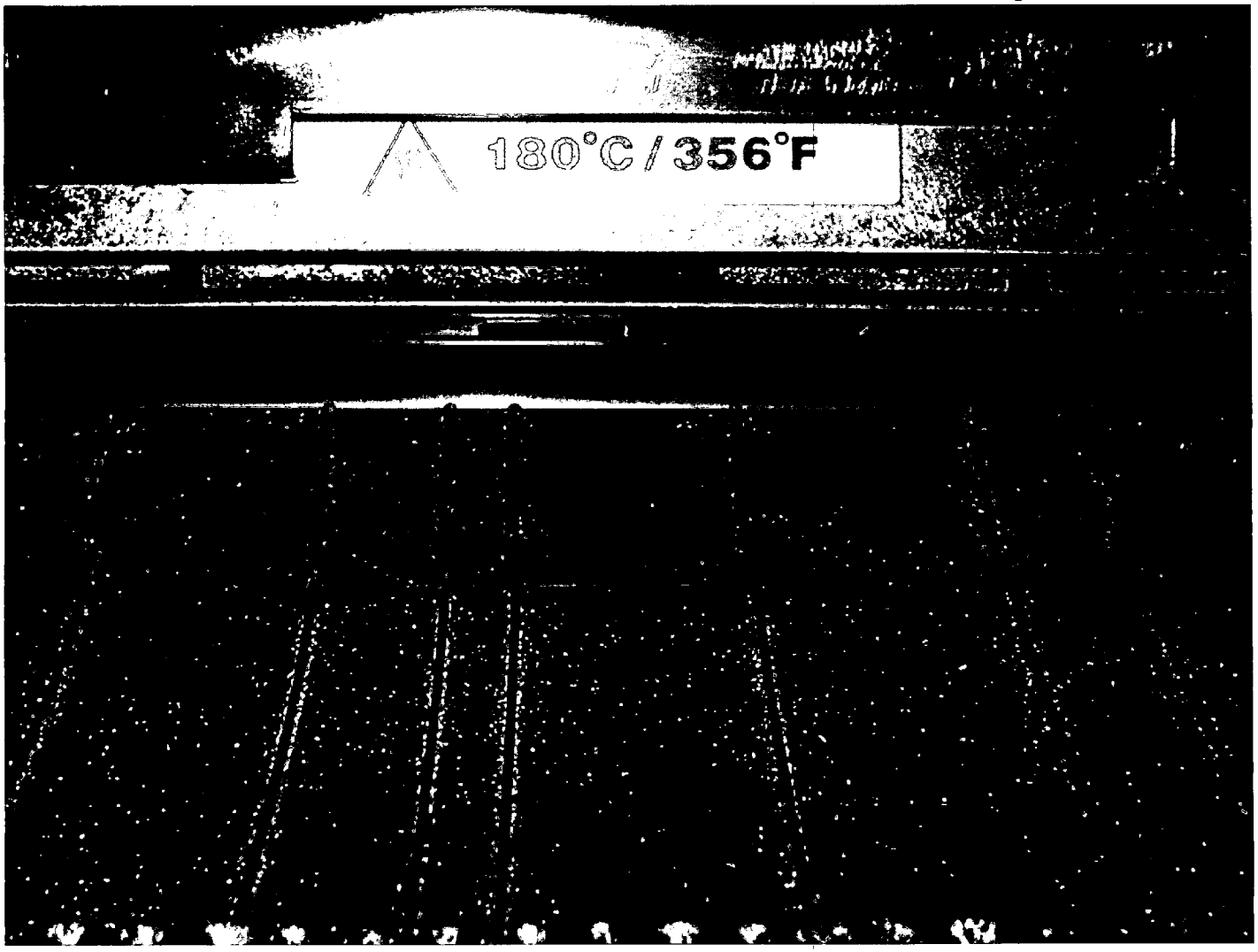
FIG. 2 is a color photograph of the fuser back-up roller of a Lexmark T-620 duplex printer after 10,000 sheets of double-sided labels were printed. The labels were coated with Arcar, Inc. Ultraforce Phase 81 as indicated in the text.
Figure 3:
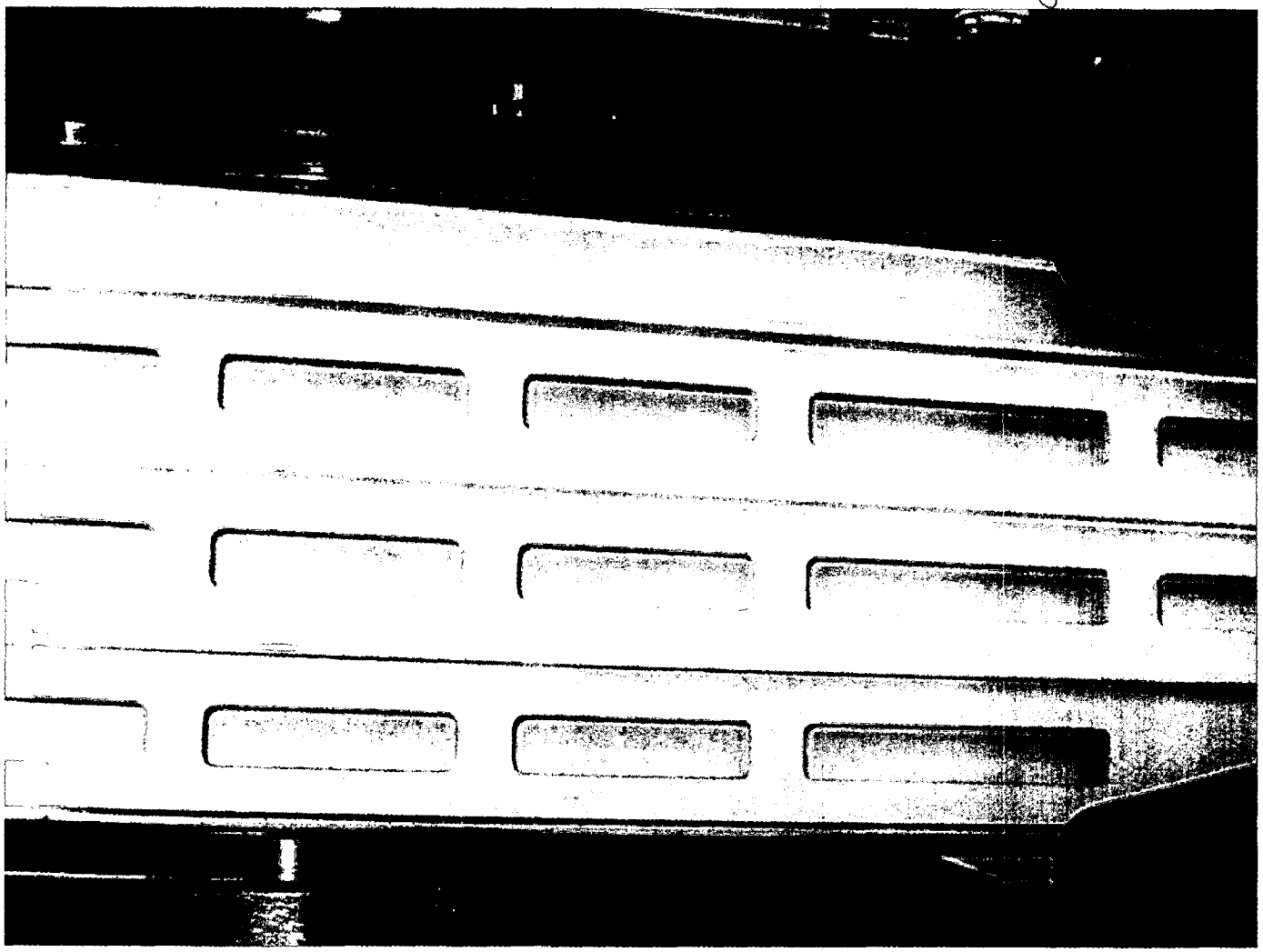
FIG. 3 is a top-view color photograph of the duplexer of a Lexmark T-620 duplex printer after 30,000 sheets of double-sided labels were printed. The labels were coated with Arcar, Inc. Ultraforce Phase 81 as indicated in the text.
Figure 4:
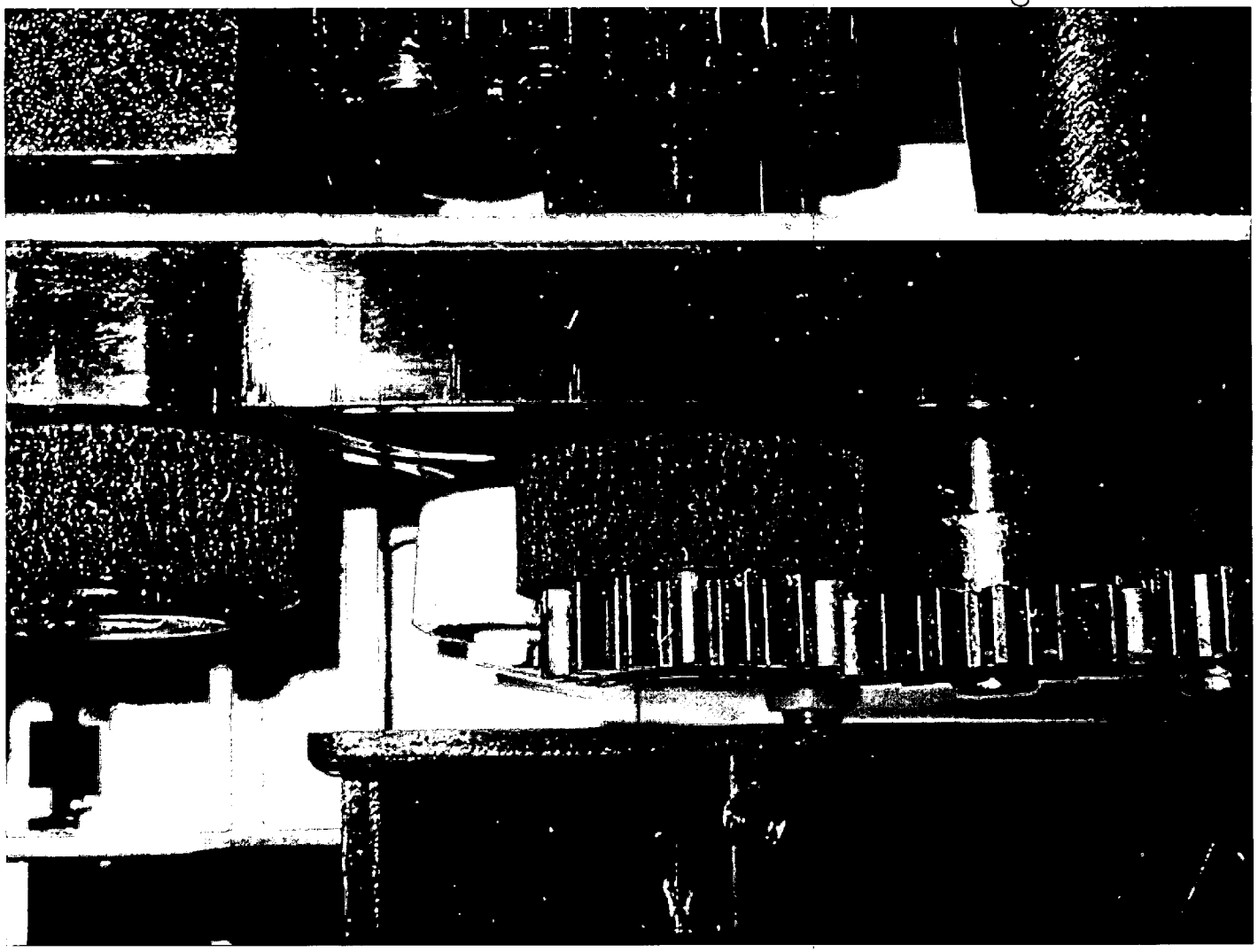
FIG. 4 is a color photograph of the duplexer rollers of a Lexmark T-620 duplex printer after 10,000 sheets of double-sided labels were printed. The labels were coated with Arcar, Inc. Ultraforce Phase 81 as indicated in the text.

FIG. 2. is a photograph of the back-up fuser roller. When using standard (i.e., uncoated) documents, the orange-colored strip in the center of the figure is contaminate with toner after just 10,000 sheets. It will be evident, however, that with the coating of the instant invention, the roller remains relatively clean. FIG. 3 and FIG. 4 show top and internal views of the rollers of the duplexer, respectively. As with the fuser and the ribs, these surfaces are noticeably cleaner than would be found under standard conditions using uncoated documents.

In the tests mentioned above, the coated documents maintained performance characteristics similar to that found with uncoated documents. For example, tests with the ARCAR product showed that the coated documents did not result in curling or misfeeding of paper through the printer, nor did the coating affect adhesion properties. The coating did not alter tape adhesion, nor introduce curling at low (about 21%) or high (about 70%) humidity conditions.

Those of ordinary skill in the art will also appreciate from the teachings disclosed herein, that certain specific properties of the coated document may be altered depending on the coating desired. Such alterations may be expected or insignificant depending on the final application and the nature of the change. However, all such coatings that confer debris-removing characteristics should be considered to be within the scope and spirit of the instant invention.

Document Preparation

The debris-removing documents of the present invention may be prepared and applied by means conventionally known in the art. Such coating techniques include, for example, printing by means of a flexographic press, offset gravure coating, direct blade coating, roll coating, and air knife coating. Further, the coating may be applied directly on a paper making machine to the document such as by the use of gate roll, twin gate roll, blade, or bill blade coaters. The document may be dried by heating or other conventional techniques after printing or coating of the debris-removing composition.

In one embodiment, the coating is first applied to an anilox roller with screen counts that may range from 200–500 lines per inch, and in other embodiments, the screen count is 360 lines per inch. The total volume of coating retained by an anilox roller is defined in billion cubic microns (BCM). In one embodiment, the anilox rollers hold from about 1.5 to about 7.0 BCM, and in other embodiments, about 4.8 BCM. The coating weight applied should be enough to insure even and 100% coverage of the desired area to be coated, and yet not an excessive amount which could lead to transfer of some of the coating to the fuser rollers. Alternatively, because of the low viscosity of the aqueous solution of the coating composition in some applications, it may be readily printed as an ink in preselected locations on the document by flexographic printing techniques. Moderate heating of the document may be desirable to facilitate printing of the composition.

Generally, the coatings of this invention may be applied to the document at a coating weight ranging from about 1.5 lbs/ream to about 5.0 lbs/ream, and more preferably ranging from about 1.6 lbs/ream to about 2.6 lbs/ream (for 24"×36" document, 500 sheets/ream). However, persons of ordinary skill in the art will understand that the coating weight will depend on the particular coating to be used.

During application, the area of document that is coated may range from "flood coating", i.e., entirely coated in the run direction, to spot coating. Moreover, one or both faces of any document may be coated, i.e., both the front and back faces. In some preferred embodiments, 20 $in^2$ (for 24"×36" document) is coated and in yet other embodiments, the document is coated 30 to 35 $in^2$ (for 24 "×36" document). The range of coating surface area is described for a single surface, but can be doubled for dual surface coatings.

The total area of the coating on the document can be a function of the printer itself. For example, if the back-up rollers are targeted for debris-removing, the document should be coated as wide as the roller and at least as long as the circumference of the roller. In some embodiments, coatings of this invention should cover an area of the document about 2 to 5 times the circumference of the roller to be affected in one direction and about the width of the roller in the other direction. In some preferred embodiments, the document is coated 3 times the surface area of the rollers to be affected. If multiple rollers are targeted for debris-removing, then their dimensions should also be taken into consideration.

Generally, document coatings are applied to printing surfaces that normally do not yield to binding toner, such as film, to enhance toner-adhesion properties of the document. Without being limited to or bound by theory, it now has been discovered that document coatings may have debris-removing characteristics, but preferably when applied to document surfaces opposite to those concurrently receiving printing indicia. In other words, for any given pass through the printer, the surface of the coated document opposite to that is being printed upon, best serves the debris-removing function. In duplex printing, where the coated document may be printed on both faces, the coating may be applied to both surfaces accordingly. In such cases, it appears that the coated surface that is not concurrently printed upon as it passes though the printer is able to serve in a debris-removing capacity.

Document Coatings

Document coatings of this invention appear to have a desirable combination or balance of the following properties as described in more detail below: heat resistance, surface tension, gentle abrasion properties, and pH. Desirable coatings of the instant invention may be found in coatings used as matting agents, extenders, abrasives, porous fillers, textile coatings, microencapsulations, cohesives, and the like. Moreover, selected coatings in some embodiments of this invention, should not alter the printing characteristics of the document from that when it is not coated. In other words, the coated document should not noticeably print differently than when not coated.

Coatings of the present invention can be selected with surface tension properties that do not render them harshly abrasive when applied to document coatings, but abrasive enough to remove debris from the roller. More specifically, the coating should not damage the rollers from abrasion, but be able to remove debris that may have accumulated. By way of comparison, documents with coatings of the invention should have a porosity ranging from about 2 to 3 times greater than that of conventional bond paper alone.

A coating with heat resistance of greater than about 250° F. is used in some embodiments, and preferably greater than about 400° F. Fuser temperatures generally reach 356° F., and the printed sheet thereby reaching temperatures of about 220° F. when passing through the printer. Accordingly, coatings of the invention are preferably selected with heat resistance specifications to preclude melting of the coating onto the printer rollers even in the event of extended time in the fuser.

It is also suspected that the pH of the coating may be important in predicting its debris-removing characteristics. For example, coatings that are more basic appear to function better in debris removal, which may be a function of their capacity to etch, and thereby remove, accumulated thermoplastic toner from the rollers. However, the appropriate pH can depend on the toner used in the printer, and should not have the unwanted side-effect of damaging the rollers.

It will be apparent to one of ordinary skill in the art from the teachings herein, however, that specific embodiments of the present invention may be directed to one, some, or all of the above- and below-mentioned characteristics as well as other characteristics, and may encompass one, some, or all of the above- and below-mentioned embodiments as well as other embodiments. Thus, for example, documents according to the present invention may be able to resist degradation resulting from heat, whereas another document according to the invention may be colored and also be able to resist degradation resulting from heat.

While the debris-removing coatings of the present invention are essentially colorless, it is within the scope of the invention to provide coloring agents to the coatings which will provide a colored surface to the coated document. Alternatively, the document itself may be colored. Preferably, the coloring agent is a pigment or encapsulated dye which imparts a color to the coating.

In combination with debris-removing coating, documents of the instant invention in most embodiments should also possess desirable properties for common usage in printers. Preferably, the document should be capable of being printed by conventional offset and/or flexographic printing presses. For example, documents of instant invention should have a range of moisture and electrical properties which render it receptive to the toners used by non-impact printing devices.

The documents in some embodiments should be compatible with a number of other business-forms related operations including perforating, slitting, gluing, and punching, for example. Likewise, the document surface should preferably be receptive to being printed upon by a variety of other printing implements including typewriters, pens, and pencils. Lastly, the document surface should be able to resist degradation resulting from rough handling, heat, and/or light exposure experienced during printing, storage, and use.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art from the teachings herein, it is not desired to limit the invention to the exact construction and operation illustrated and described, and accordingly, all suitable modifications and equivalents may be resorted to, falling within the scope of the invention.

What is claimed is:

1. A document with debris-removing characteristics, the document comprising:

a substrate having a first face and an opposing second face;

a first label, at least a portion of the first label releasably adhered to at least a portion of the first face, the first label being capable of receiving printing indicia; and a debris-removing coating associated with at least a portion of the second face to remove printer debris during passage of the document through a printer for printing the printing indicia upon the first label.

2. A document as in claim 1, wherein the debris-removing coating is chosen from polymeric coatings.

3. A document as in claim 1, wherein the substrate includes a colored sheet.

4. A document as in claim 1, wherein the debris-removing coating is further associated with at least a portion of the first label.

5. The document of claim 4, wherein at least a portion of the second face includes a second label releasably adhered thereto and configured to receive printing indicia, the debris-removing coating associated with the at least a portion of the second face is positioned on at least a portion of the second label, the debris-removing coating associated with the at least a portion of the first label is positioned on the at least a portion of the first label, and the debris-removing coating is configured to remove printer debris during passage of the document through a printer while printing the printing indicia upon at least one of the first label and the second label.

6. The document of claim 1, wherein the debris-removing coating includes a laser-receptive cleansing coating.

7. A document as in claim 6, wherein the debris-removing coating is the product Ultraforce Phase 81.

8. The document of claim 1, further comprising:

a second label, at least a portion of the second label releasably adhered to at least a portion of the second face so as to form, with the first label, a duplex self-adhesive label;

wherein the debris-removing coating associated with the at least a portion of the second face is positioned on the at least a portion of the second label.

9. A method of producing a document with debris-removing characteristics, the method comprising:

providing a document having a first face and an opposing second face, at least a portion of the first face including a first label releasably adhered thereto, the first label being capable of receiving printing indicia; and associating a debris-removing coating with at least a portion of the second face to remove printer debris during passage of the document through a printer for printing the printing indicia upon the first label.

10. A method as in claim 9, wherein the debris-removing coating is chosen from polymeric coatings.

11. A method as in claim 9, wherein the document includes a colored sheet.

12. A method as in claim 9, wherein the debris-removing coating is further associated with at least a portion of the first label.

13. The method of claim 12, wherein at least a portion of the second face includes a second label releasably adhered thereto and configured to receive printing indicia, the debris-removing coating associated with the at least a portion of the second face is positioned on at least a portion of the second label, the debris-removing coating associated with the at least a portion of the first label is positioned on the at least a portion of the first label, and the debris-removing coating is configured to remove printer debris during passage of the document through a printer while printing the printing indicia upon at least one of the first label and the second label.

14. The method of claim 9, wherein the debris-removing coating includes a laser-receptive cleansing coating.

15. A method as in claim 14, wherein the debris-removing coating is the product Ultraforce Phase 81.

16. The method of claim 9, further comprising:

a second label releasably adhered to at least a portion of the second face so as to form, with the first label, a duplex self-adhesive label;

wherein the debris-removing coating associated with the at least a portion of the second face is positioned on the at least a portion of the second label.

17. A method of reducing printing contamination, the method comprising:

providing a document having a first face, an opposing second face, and a debris-removing coating, at least a portion of the first face including a first label releasably adhered thereto, the debris-removing coating associated with at least a portion of the second face to remove printer debris during passage of the document through a printer for printing indicia upon the first label; and passing the document with the first label releasably adhered to the first face through the printer.

18. A method as in claim 17, wherein the document includes a colored sheet.

19. A method as in claim 17, wherein the debris-removing coating is chosen from polymeric coatings.

20. A method as in claim 17, wherein the debris-removing coating is further associated with at least a portion of the first label.

21. The method of claim 20, wherein at least a portion of the second face includes a second label releasably adhered thereto and configured to receive printing indicia, the debris-removing coating associated with the at least a portion of the second face is positioned on at least a portion of the second label, the debris-removing coating associated with the at least a portion of the first label is positioned on the at least a portion of the first label, and the debris-removing coating is configured to remove printer debris during passage of the document through a printer while printing the printing indicia upon at least one of the first label and the second label.

22. The method of claim 17, wherein the contamination is ink deposits.

23. The method of claim 17, wherein the contamination is paper dust deposits.

24. The method of claim 17, wherein the contamination is adhesive build-up.

25. The method of claim 17, wherein the debris-removing coating includes a laser-receptive cleansing coating.

26. A method as in claim 25, wherein the debris-removing coating is the product Ultraforce Phase 81.

27. The method of claim 17, further comprising:

a second label releasably adhered to at least a portion of the second face so as to form, with the first label, a duplex self-adhesive label;

wherein the debris-removing coating associated with the at least a portion of the second face is positioned on the at least a portion of the second label.

28. A method for removing printer debris, the method comprising:

providing a document with debris-removing characteristics, the document including a first face and an opposing second face, at least a portion of the first face including a first label releasably adhered thereto and configured to receive printing indicia, at least a portion of the second face associated with a coating configured to remove printer debris during passage of the document through a printer, passing the document with the first label releasably adhered to the first face through the printer, and printing the printing indicia upon the first face label during passage of the document through the printer.

29. The method of claim 28, wherein at least a portion of the first label is associated with the coating, at least a portion of the second face includes a second label releasably adhered thereto and configured to receive printing indicia, the coating associated with the at least a portion of the second face positioned on at least a portion of the second label, the coating associated with the at least a portion of the first label is positioned on the at least a portion of the first label, and the coating is configured to remove printer debris during passage of the document through a printer for printing the printing indicia upon at least one of the first label and the second label, the method further comprising:

re-passing the document through the printer, and printing the printing indicia upon the second label during re-passage of the document through the printer.

30. The method of claim 28, wherein the coating includes a laser-receptive cleansing coating.

* * * * *